US006065822A

United States Patent [19]

Sarraf

[11] Patent Number: 6,065,822

[45] Date of Patent: May 23, 2000

[54] PRINTER CAPABLE OF PRODUCING CONTINUOUS TONE PRINTS FROM MULTI-BIT DATA SIGNALS

[75] Inventor: Sanwal P. Sarraf, Pittsford, N.Y.

[73] Assignee: Eastman Kodak Company, Rochester, N.Y.

[21] Appl. No.: 08/633,277

[22] Filed: Apr. 16, 1996

[51] Int. Cl.[7] ..... B41J 2/205; B41J 2/21; B41J 2/04

[52] U.S. Cl. ..... 347/15; 347/43; 347/54

[58] Field of Search ..... 347/15, 40, 42, 347/43, 44, 54

[56] References Cited

U.S. PATENT DOCUMENTS

| | | | |
|---|---|---|---|
| 4,215,350 | 7/1980 | Miekle et al. | 346/75 |
| 4,513,299 | 4/1985 | Lee et al. | 346/140 R |
| 4,746,935 | 5/1988 | Allen | 347/15 |
| 4,750,009 | 6/1988 | Yoshimura | 346/140 R |
| 4,900,130 | 2/1990 | Haas | 350/321 |
| 5,146,236 | 9/1992 | Hirata et al. | 346/140 R |
| 5,196,236 | 3/1993 | Howard et al. | 346/1.1 |
| 5,208,605 | 5/1993 | Drake | 346/1.1 |
| 5,235,352 | 8/1993 | Pies et al. | 346/140 R |
| 5,611,630 | 3/1997 | Dolan et al. | 347/188 |
| 5,650,803 | 7/1997 | Tamura et al. | 347/15 |

*Primary Examiner*—Peter S. Wong
*Assistant Examiner*—Bao Q. Vu
*Attorney, Agent, or Firm*—Walter S. Stevens

[57] ABSTRACT

An ink-jet printer capable of providing a large number of gray levels delivers ink for each pixel through several nozzles for each color, with each nozzle corresponding to a bit of the pixel's image data word. The nozzle corresponding to the least significant bit of the image data word has a capacity to deliver an amount of ink just sufficient to produce 1/256 of the maximum desired density on the media. The second nozzle, corresponding to the next least significant bit of the image data word, has a capacity to deliver twice as much ink as the first nozzle. The third nozzle delivers twice as much ink as the second nozzle (and four times as much as the first nozzle), and so on. The last nozzle delivers 128 times as much ink as the first nozzle. Control of each nozzle is time-sequenced to print each pixel of the image as the printhead scans over the media. The ink is delivered to the image pixel according to the value of the image data word.

6 Claims, 2 Drawing Sheets

PRINTER CAPABLE OF PRODUCING CONTINUOUS TONE PRINTS FROM MULTI-BIT DATA SIGNALS

BACKGROUND OF THE INVENTION

1. Technical Field

The present invention relates generally to drop-on-demand ink-jet printers, and more particularly to such printers capable of producing continuous tone prints from multi-bit data signals.

2. Background Art

True continuous tone images generally require 256 gray levels for of each primary color. Many processes are known for producing digital images using ink-jet printing. Most of these processes do not provide adequate gray level for good continuous tone images. Two very common methods of forming images using ink-jet printing are called *continuous ink flows and "drop-on demand".

In continuous ink flow systems, the amount of ink reaching a receiver medium from the nozzle is controlled to provide the desired density of each image pixel. In this process, it is very difficult to accurately meter the amount of ink from one nozzle; the relative motion between nozzle and media blurs the image; and media wetting and ink dripping results from quickly transferring large volumes of ink. It has been very difficult to obtain 256 gray levels from the continuous ink flow technique, and moreover these systems are very expensive.

In drop-on demand systems, ink is delivered one drop at a time, and printed gray level is conventionally controlled by regulating the number of drops leaving the nozzle to be delivered to the receiver media. It is believed that a 256 gray level system has not yet been successfully demonstrated. It is also believed that the problem, that of getting enough density resolution with each drop lies, in difficulty controlling the number of drops from each nozzle; the relative motion between media and the nozzle; and/or the frequency of drop formation.

DISCLOSURE OF THE INVENTION

It is an object of the present invention to provide a drop-on-demand ink-jet printer capable of providing a large number of gray levels.

It is another object of the present invention to provide a multi-color drop-on-demand ink-jet printer capable of providing a large number of gray levels for each color.

It is still another object of the present invention to provide a color drop-on-demand ink-jet printer capable of providing a large number of gray levels for each primary color and black.

It is yet another object of the present invention to provide a drop-on-demand ink-jet printer capable of providing at least 256 gray levels for each primary color and black.

It is another object of the present invention to provide a drop-on-demand ink-jet printer that delivers ink for each pixel through several nozzles for each color, with each nozzle corresponding to a bit of the pixel's image data word. For example, a 256 level capable printhead will have at least eight nozzles for each color.

According to a feature of the present invention, a 256 gray level printhead has at least eight nozzles corresponding to eight bits of each image data word. In a color printhead, there would be eight nozzles for each color. The nozzle corresponding to the least significant bit of the image data word has a capacity to deliver an amount of ink just sufficient to produce 1/256 of the maximum desired density on the media. The second nozzle, corresponding to the next least significant bit of the image data word, has a capacity to deliver twice as much ink as the first nozzle. The third nozzle delivers twice as much ink as the second nozzle (and four times as much as the first nozzle), and so on. The last nozzle (the eighth nozzle in this example) delivers 128 times as much ink as the first nozzle.

Control of each nozzle is time-sequenced to print each pixel of the image as the printhead scans over the media. The ink is delivered to the image pixel according to the value of the image data word. For example, if a data word value of a particular image pixel for the red record is thirty-three, then only the first and sixth nozzles of the red printhead will be activated for the particular image pixel as the printhead crosses the pixel. Similar operation will take place for the same pixel for green and blue heads according to their image value. This operation is continued for the entire image, either color or monochrome.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
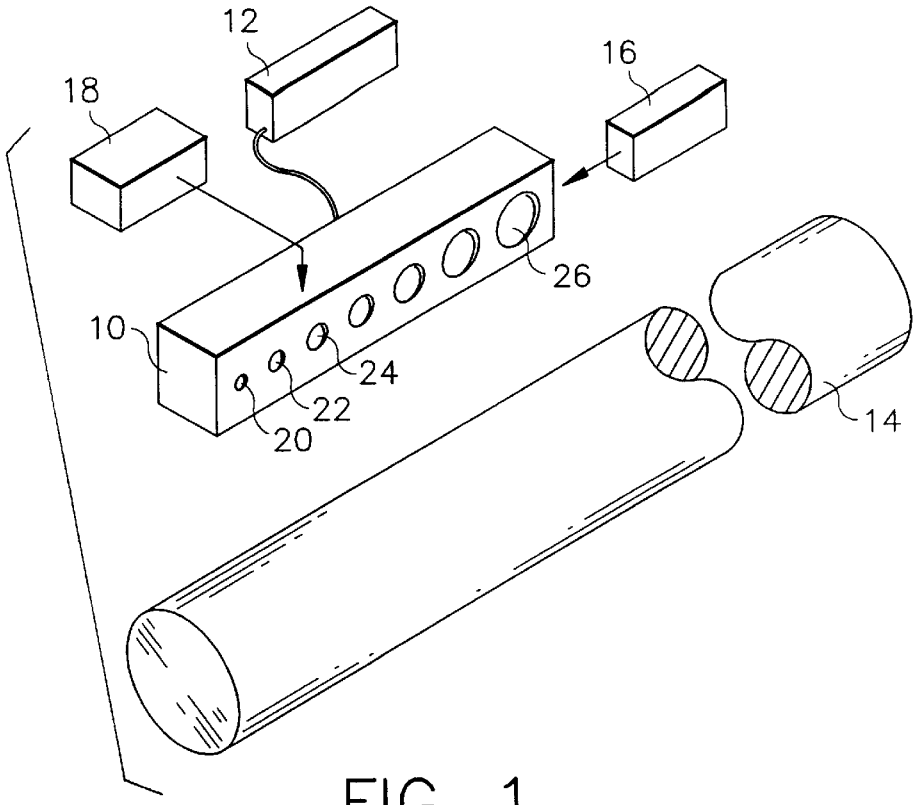
FIG. 1 is a perspective schematic view of a printhead according to the present invention.

Referring to FIG. 1, a printhead 10 for producing one color with eight nozzles is shown. The printhead receives ink from a reservoir 12, is translated along a platen 14 by a moving mechanism 16, and ejects ink as directed by a controller 18. The nozzles range in size (or ink-delivery capacity) from a least significant nozzle 20 having a capacity to deliver a predetermined quantity of ink sufficient to produce only 1/256 of the maximum desired density of each pixel. The next nozzle 22 has a capacity to deliver twice as much ink as can be delivered by the first nozzle. The third nozzle 24 has a capacity to deliver twice as much ink as can be delivered by the second nozzle (and four times as much as the first nozzle), and so on. Thus, the eighth nozzle 26 has a capacity to deliver 128 times as much ink as can be delivered by the first nozzle.

Figure 2:
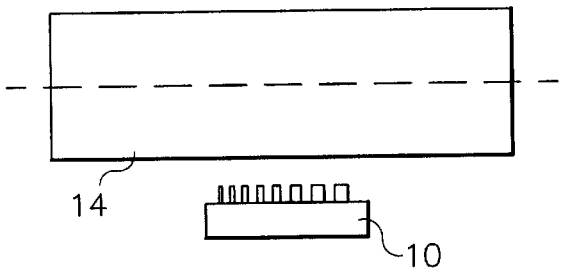
FIGS. 2 and 3 are schematic side and end views, respectively, of the printhead of FIG. 1 being used in a printer.
Figure 3:
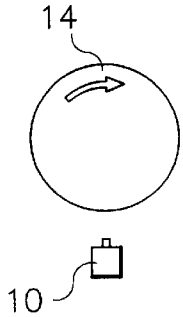

Referring to FIGS. 2 and 3, printhead 10 is mounted in a printer for movement relative to platen 14 in the direction of an arrow 30. The platen, illustrated as a rotating drum, advances receiver media in a direction orthogonal to the direction of arrow 30.

If the physical separation between nozzles on the printhead is "d", then the raster spacing "y" between each print line can be "d", any integer division of "d", or any integer multiplication of "d".

The head is moved such as by means of a ribbon and belt, leader screw, or linear motor by the raster spacing "y". Thus, the nozzle separation may be greater than the raster spacing, so that coarsely populated nozzles can be used for a very high resolution printing; minimizing the printhead cost.

Ink delivery from the nozzles may, as examples, be by thermal, piezo, or continuous ink-jet devices; which are well known in the art. Activation of each nozzle is time-sequenced to print each pixel of the image as the printhead scans over the media. The ink is delivered to a particular pixel of the image according to the value of the image data word. For example, if a data word value of a particular image pixel is thirty-three, then only the first and sixth nozzles of the printhead will be activated for the particular image pixel as the printhead crosses the pixel. This operation is continued for the entire image.

Figure 4:
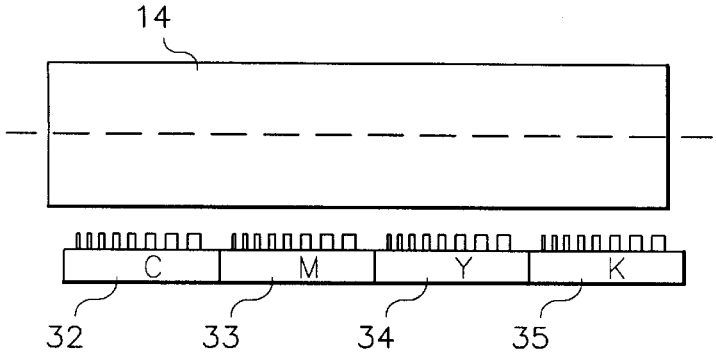
FIGS. 4 and 5 are schematic side and end views, respectively, of the use of four printheads of FIG. 1 being used in a full color printer.
Figure 5:
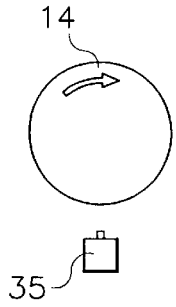

A full color printhead comprising three primary colors plus black (which is optional) is shown in FIGS. 4 and 5. Here four printheads 32–35 are assembled together along the longitudinal axis of platen 14, either on the same substrate or separately. The physical distance separating the last nozzle of one printhead and first nozzle of next printhead is same as the separation between nozzles of each printhead. Again, a raster spacing "y" can be the same as nozzle separation "d", an integer which is a multiple of "d", or an integer which is a divisible of "d".

Each nozzle of each color printhead traverses each and every pixel of the image. However, only those nozzles in each color printhead which correspond to the value of the data word of the image pixel for that color are energized.

Figure 6:
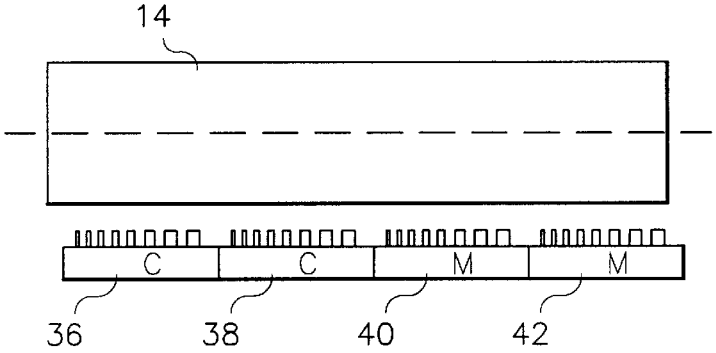
FIGS. 6 and 7 are schematic side and end views, respectively, of the use of eight printheads of FIG. 1 being used in a full color, high speed printer.
Figure 7:
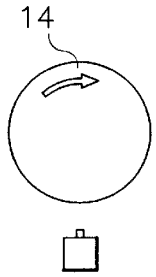

Another embodiment is shown in FIGS. 6 and 7. Here, a printhead pair 36, 38 of the same color (cyan, for example) is used to increase the printing rate. A second printhead pair 40, 42 of another color (magenta, for example) is also provided. This arrangement is illustrated as being of contiguous color, but alternating colors could be successfully used. If there are "N" printheads for each color and the raster spacing required is "y", then the size of each step (the distance that the printhead moves in a single rotation of platen 14 or in a single traverse of a flat bed platen) of the printhead is "N" multiplied by "y". The separation "d" between nozzles in a printhead can be "N" multiplied by "y" or any integer multiple or division of "N" multiplied by "y".

Similarly, if the distance between corresponding nozzles of each color in two or more printheads of the same color is "L", then the interleaving factor is "L" divided by "y". The interleaving factor cannot have a common factor with the number of printheads of each color so that a line written by one nozzle of a printhead is necessarily not overwritten by a nozzle of another printhead. In FIG. 6, only two printheads of two colors Cyan and Magenta have been shown for clarity. The actual configuration will have printheads of all colors and two or more than two of each color.

Figure 8:
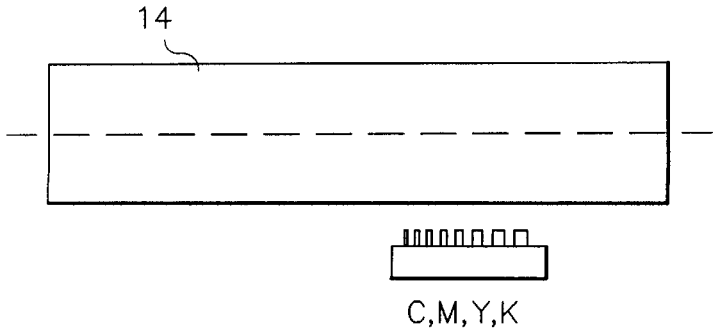
FIGS. 8 and 9 are schematic side and end views, respectively, of the use of four printheads of FIG. 1 being used in a full color printer.
Figure 9:
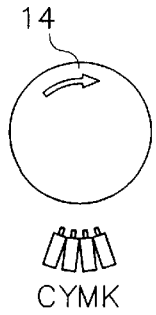

Another embodiment is shown in FIGS. 8 and 9, where all printheads of different colors are stacked to form a full color printhead. The printheads are angularly positioned to view the same pixel sequentially. Alternatively, the printheads may be angularly positioned to view the same pixel simultaneously. Again, all nozzles of all printheads traverse through each and every pixel of the image to expose the pixel according to the data word value of the pixel for each color. The operation of this arrangement is very similar to that of the monochrome printhead operation described above, except that each color nozzle sees every pixel.

The invention has been described in detail with particular reference to preferred embodiments thereof, but it will be understood that variations and modifications can be effected within the spirit and scope of the invention. For example, the present invention can be extended if more or less than 256 levels of each primary color are required. For higher throughput and resolution, many printheads of the same color can be interleaved.

What is claimed is:

1. An ink-jet printhead comprising a plurality of ink-delivery nozzles, a supply of ink coupled to said nozzles for supplying ink to said nozzles, a platen associated with said nozzles, a controller coupled to said nozzles for selectively actuating each of said nozzles to deliver ink therefrom, and a moving mechanism connected to said nozzles for translating said nozzles with respect to said platen, wherein a first one of said nozzles is adapted to produce a predetermined density spot when activated, a second one of said nozzles adjacent to said first nozzle is adapted to produce a spot of approximately twice said predetermined density when activated, a third one of said nozzles adjacent to said second nozzle is adapted to produce a spot of approximately four times said predetermined density when activated, and so on for all of said plurality of nozzles.

2. An inkjet printhead comprising a plurality of ink-delivery nozzles, a supply of ink coupled to said nozzles for supplying ink to said nozzles, a platen associated with said nozzles, a controller coupled to said nozzles for selectively actuating each of the nozzles to deliver ink therefrom, and a moving mechanism connected to said nozzles for translating said nozzles with respect to said platen, wherein a first one of said nozzles is adapted to deliver a predetermined amount of ink therefrom when activated, a second one of said nozzles adjacent to said first nozzle is adapted to deliver approximately twice said predetermined amount of ink therefrom when activated, a third one of said nozzles adjacent to said second nozzle is adapted to deliver four times said predetermined amount of ink therefrom when activated, and so on for all of said plurality of nozzles.

3. An ink-jet printhead as set forth in claim 2 wherein the printhead is a drop-on-demand printhead.

4. A color inkjet printer comprising a plurality of printheads for delivery of different color inks, each of said printheads having a plurality of ink-delivery nozzles, a supply of ink coupled to said nozzles for supplying ink to said nozzles, a platen associated with said nozzles, a controller coupled to said nozzles for selectively actuating each of the nozzles to deliver ink therefrom, and a moving mechanism connected to said nozzles for translating said nozzles with respect to said platen, wherein a first one of said nozzles of each printhead is adapted to produce a predetermined density spot when activated, a second one of said nozzles adjacent to said first nozzle of each printhead is adapted to produce a spot of approximately twice said predetermined density when activated, a third one of said nozzles adjacent to said second nozzle of each printhead is adapted to produce a spot of approximately four times said predetermined density when activated, and so on for all of said plurality of nozzles.

5. A color ink-jet printer comprising a plurality of printheads for delivery of different color inks, each of said printheads having a plurality of ink-delivery nozzles, a supply of ink coupled to said nozzles for supplying ink to said nozzles, a platen associated with said nozzles, a controller coupled to said nozzles for selectively actuating each of the nozzles to deliver ink therefrom, and a moving mechanism connected to said nozzles for translating said nozzles with respect to said platen, wherein a first one of said nozzles of each printhead is adapted to deliver a predetermined amount of ink therefrom when activated, a second one of said nozzles adjacent to said first nozzle of each printhead is adapted to deliver approximately twice said predetermined amount of ink therefrom when activated, a third one of said nozzles adjacent to said second nozzle of each printhead is adapted to deliver four said predetermined amount of ink therefrom when activated, and so on for all of said plurality of nozzles.

6. An ink-jet printhead comprising a plurality of ink-delivery nozzles corresponding to a number of data bits of image data words to be printed for each pixel, a supply of ink coupled to said nozzles for supplying ink to said nozzles, a platen associated with said nozzles, a controller coupled to said nozzles for selectively actuating each of the nozzles to deliver ink therefrom, and a moving mechanism connected to said nozzles for translating said nozzles with respect to said platen, wherein a first one of said nozzles is adapted to produce a density spot corresponding to a least significant bit of the image data word when activated, a second one of said nozzles adjacent to said first nozzle is adapted to produce a density spot corresponding to a second least significant bit of the image data word when activated, a third one of said nozzles adjacent to said second nozzle is adapted to produce a density spot corresponding to a third least significant bit of the image data word when activated, and so on for all of said plurality of nozzles.

* * * * *

UNITED STATES PATENT AND TRADEMARK OFFICE

CERTIFICATE OF CORRECTION

PATENT NO. : 6,065,822
DATED : May 23, 2000
INVENTOR(S) : Sanwal P. Sarraf

It is certified that error appears in the above-identified patent and that said Letters Patent is hereby corrected as shown below:

title page, insert -- Related US Application Data [60] Provisional Application No. 60/003,630 filed September 12, 1995 --

Signed and Sealed this

First Day of May, 2001

*Attest:*

Nicholas P. Godici

NICHOLAS P. GODICI

*Attesting Officer*

*Acting Director of the United States Patent and Trademark Office*